US007569997B2

(12) United States Patent
Huang et al.

(10) Patent No.: US 7,569,997 B2
(45) Date of Patent: Aug. 4, 2009

(54) SELF-CALIBRATED INTEGRATION METHOD OF LIGHT INTENSITY CONTROL IN LED BACKLIGHTING

(75) Inventors: Hsin Chiang Huang, Chupei (TW); Chang Kuang Chung, Chupei (TW)

(73) Assignee: Ascend Visual System, Inc., San Jose, CA (US)

( * ) Notice: Subject to any disclaimer, the term of this patent is extended or adjusted under 35 U.S.C. 154(b) by 190 days.

(21) Appl. No.: 11/744,868

(22) Filed: May 6, 2007

(65) Prior Publication Data

US 2008/0272276 A1 Nov. 6, 2008

(51) Int. Cl.
*H05B 37/02* (2006.01)

(52) U.S. Cl. ..... 315/291; 315/294; 315/308; 345/76; 345/82; 345/102

(58) Field of Classification Search ..... 315/225, 315/246–247, 291, 297, 302, 307–308, 294; 345/82, 86–87, 102, 204, 76
See application file for complete search history.

(56) References Cited

U.S. PATENT DOCUMENTS

| | | | | |
|---|---|---|---|---|
| 6,211,626 | B1 * | 4/2001 | Lys et al. | 315/291 |
| 7,221,104 | B2 * | 5/2007 | Lys et al. | 315/291 |
| 2003/0020677 | A1 * | 1/2003 | Nakano | 345/87 |
| 2003/0043133 | A1 * | 3/2003 | Tzelnick | 345/204 |
| 2003/0085854 | A1 * | 5/2003 | Tsuji | 345/82 |
| 2006/0221046 | A1 * | 10/2006 | Sato et al. | 345/102 |
| 2008/0018575 | A1 * | 1/2008 | Kobayashi et al. | 345/87 |
| 2008/0042936 | A1 * | 2/2008 | Wang | 345/76 |

* cited by examiner

*Primary Examiner*—David Hung Vu
*Assistant Examiner*—Tung X Le
(74) *Attorney, Agent, or Firm*—Ming Chow; Sinorica, LLC

(57) ABSTRACT

This invention is an LED lighting intensity control by subdivision of PWM intervals to resolve the wavelength and luminance shifting problems that are caused by increasing heat and junction temperatures.

12 Claims, 6 Drawing Sheets

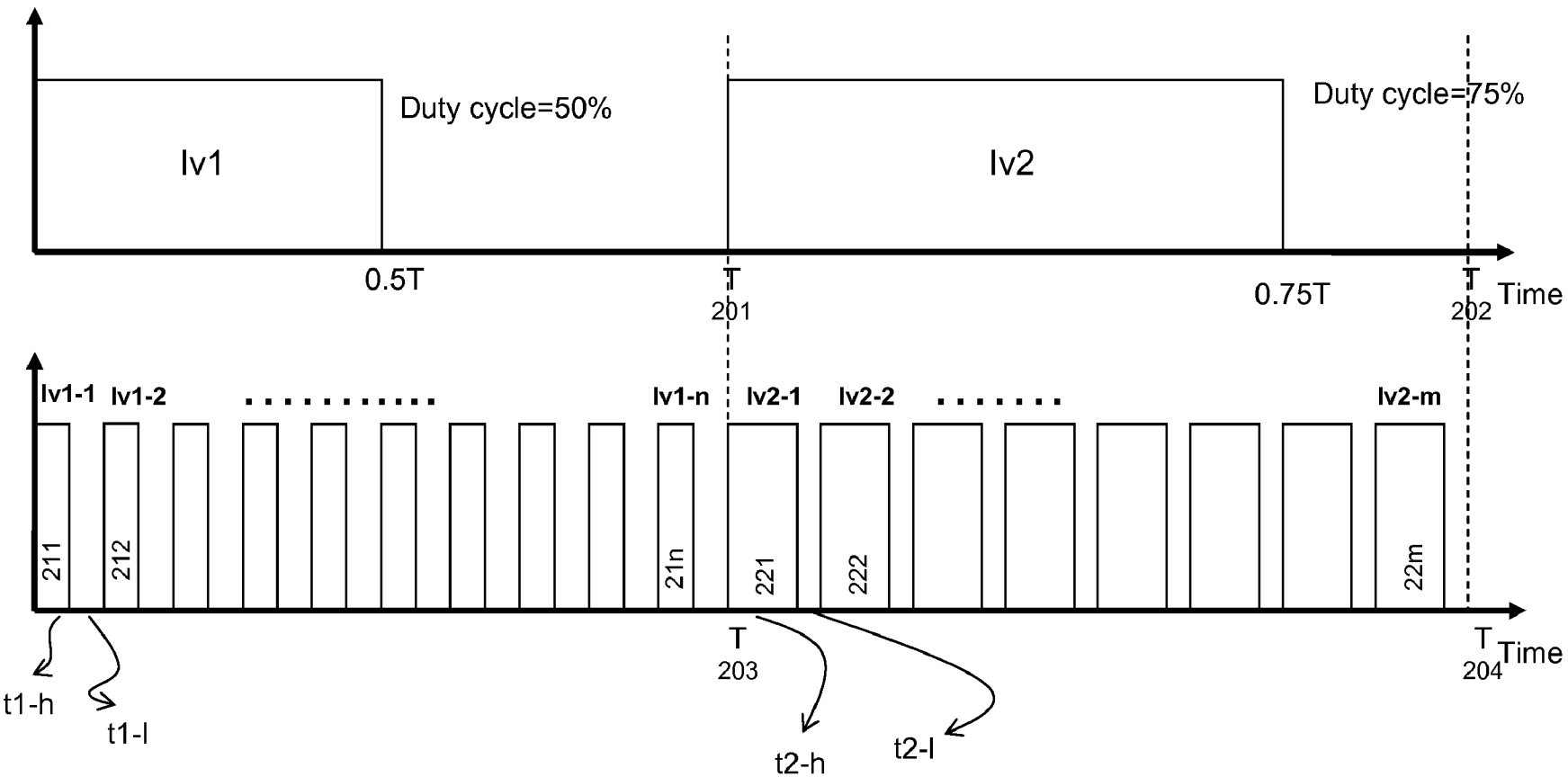
Fig. 2A PWM Control
Fig. 2B Integration Control

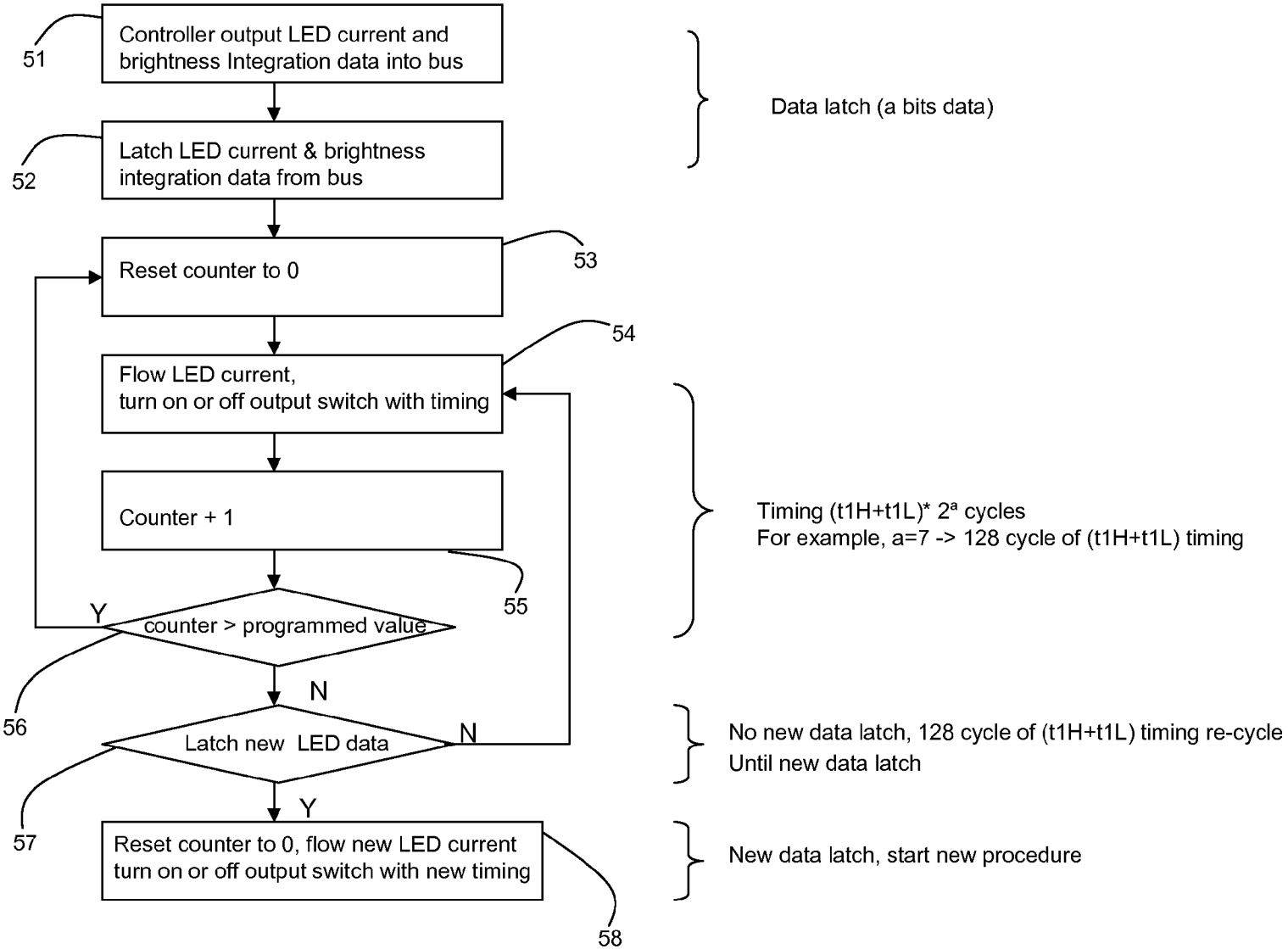
Fig. 5 Algorithm Flow

SELF-CALIBRATED INTEGRATION METHOD OF LIGHT INTENSITY CONTROL IN LED BACKLIGHTING

FIELD OF INVENTION

This invention relates to an intensity control technology on Light Emitting Diode (LED) in order to resolve the problems of LED light wavelength and luminance shifting.

BACKGROUND OF INVENTION

The LED technology has been widely used in various applications for backlighting purposes. In order to display the images by using LEDs, the brightness of LEDs is a major consideration and technology to be implemented. The industries have been implementing Pulse Width Modulation (PWM) in controlling the LED backlight brightness. The LED is turned on during its Duty Cycle according to the control of the MCU (Micro Control Unit) in accordance with each Frame Time. Therefore, the temperature or the heat is generated through the duration of turning-on the LEDs until the end of its Duty Cycle.

The current invention takes advantage of the integration function that human eyes inherently bear, by scaling and subdividing the PWM intervals in order to reduce the continuous time of turning-on the LEDs. Consequently, the temperature and heat generated is also reduced while the displaying of image frames are still maintained and perceived by the human being.

SUMMARY OF THE INVENTION

The LED technology has been widely used in the last many years. The applications included many different industries, for example, television set, computer monitor, cell phone display screen, etc. The biggest advantage of using LED as the lighting source is that the LEDs do not fail and causes the application losing its displaying function completely. Instead, the LEDs lighting capability degrades through its life span and mainly caused by the increasing heat and junction temperatures.

Conventionally, the LED technology implements the PWM to control the lighting of the LEDs. By varying the Duty Cycle, the PWM defines the LED lighting ON and OFF period for each image frame. The Duty Cycle calculated and defined by the PWM is based on the frame time. In other words, the LEDs are turned ON continuously through the time-length of displaying the image frame from its beginning to the end. Therefore, the heat and the junction temperature are increased through the time when the LEDs are turned on.

In order to increase or maintain the LEDs life span and lighting quality, the heat and junction temperature generated during the time when the LEDs are turned on must be reduced. This invention implements a technology to subdivide the PWM intervals for a required Duty Cycle when displaying the images. The subdivisions of the PWM intervals increase the frequencies of turning-off the LEDs before the heat and junction temperatures are accumulated. The total subdivisions of turning-on intervals remains the same for a required Duty Cycle. The current invention does not compromise the displaying requirements because human eyes inherently have the integration function to light luminance and colors. The sub-divided time periods of turning-on and turning-off of the LEDs are sufficient and long enough for the human eyes to build the images and wait for the next image light. By cooling off the heat and junction temperature more often before its accumulated, the wavelength and luminance shifting are reduced and therefore the LEDs lighting quality is maintained and improved.

BRIEF DESCRIPTION OF THE DRAWINGS

FIGS. 2A and 2B show the difference between a conventional PWM control and the PWM integration control by the current invention

FIG. 5 shows an algorithm flow of the PWM integration control processes

DETAIL DESCRIPTIONS OF THE INVENTION

Terminology and Lexicography:

Latching: The function of receiving data from a data bus and storing the data in a register or memory.

Frame Time: The time period of displaying an image on a displaying system. A common practice of the Frame Time is 1/60 seconds although the Frame Time may be implemented differently for various application requirements.

$2^{bd}$: Two (2) to the power of bd, wherein bd is an integer.

Figure 1A:
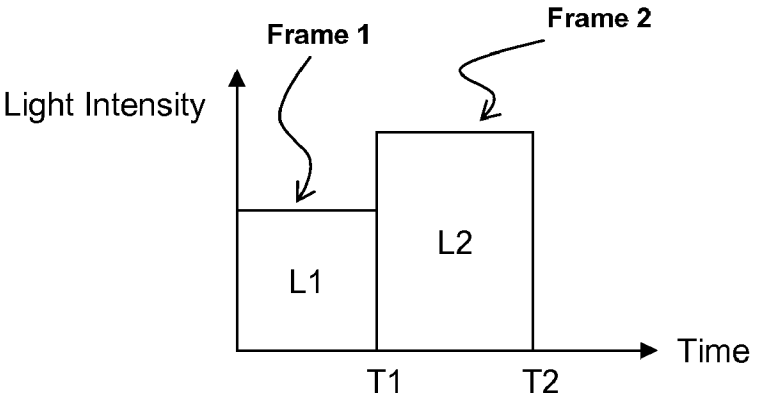
Fig. 1A (Prior Art)
FIG. 1A shows relationships between conventional LED frame-lighting intensity and its total displaying time
Figure 1B:
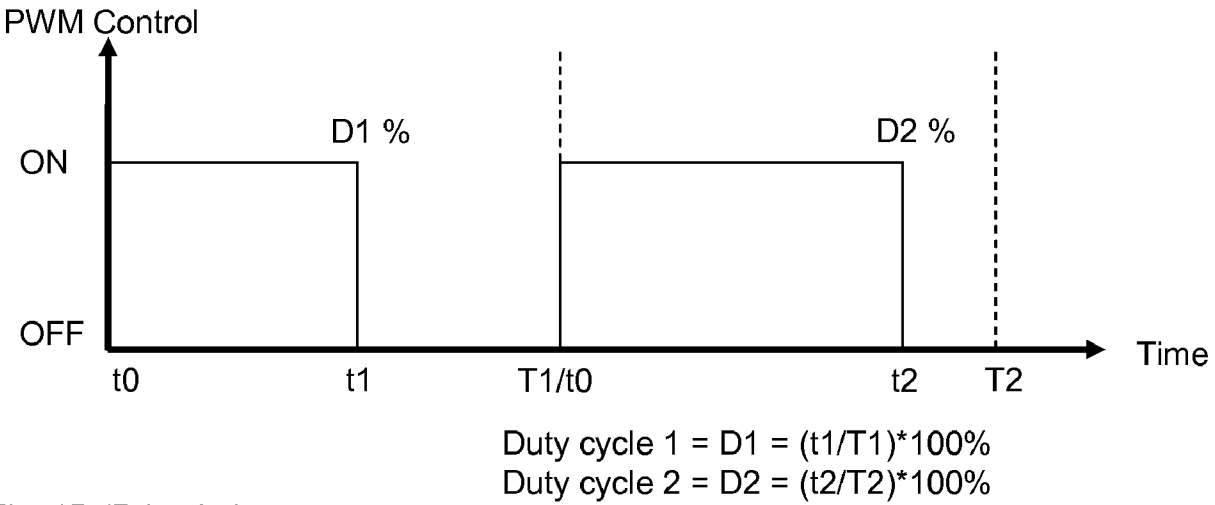
Fig. 1B (Prior Art)
FIG. 1B shows conventional PWM control on LED lighting with different Duty Cycles

The PWM technology has been conventionally implemented to control the LED backlight brightness. The FIG. 1A shows the desired image light intensity L1 and L2 in the frame time T1 and T2. The FIG. 1B shows the PWM control on the L1 and L2 as illustrated by the FIG. 1A. For the frame time T1, the control signal generated by a MCU (306) turns on the LED from time t0 to t1 and turns off the LED for rest of the time within T1 frame time. The t1, or the Duty Cycle (D1) determines the light intensity of frame 1. The t2, or the Duty Cycle (D2), determines the light intensity of frame 2. The D1 is defined as (t1/T1)*100% and the D2 is defined as (t2/T2) *100% where T1 and T2 are frame time for frame 1 and frame 2 respectively. The LED junction temperature continuously increases as long as the LED is turned ON. The increased junction temperature becomes significant and leads to LED light wavelength and luminance shifting which jeopardizes the LED's lighting quality.

The current invention implements a PWM Integration Control by subdividing the conventional PWM intervals into shorter-time periods of intervals for ON and OFF states. The FIG. 2A and FIG. 2B show the relationships between the conventional PWM and the PWM Integration Control. The light intensity within each frame time (T; 201, 202, 203, 204) is divided into a group of discrete sub-light intensity. The integration of those sub-light intensity results into the same light intensity within the frame time as the conventional PWM has. The FIG. 2B shows a 50% Duty Cycle for frame 1 is equally divided into n sub-intervals for ON state and n sub-intervals for OFF state, where n is in the range of several hundred thousands intervals as per current LED and Driver IC circuit technology. Although the value of the counter n is a design issue for each manufacturing, however, currently the best mode can be achieved within the range of 6 bits and 8 bit ($2^6$~$2^8$). The current invention does not limit to a specific range of value for the counter n as long as the integration of sub-intervals meets the requirements of light intensity. The FIG. 2B shows a 50% Duty Cycle (lv1) is integrated by (lv1−1)+(lv1−2)+ . . . +(lv1−n)=lv1, and a 75% Duty Cycle (lv2) is integrated by (lv2−1)+(lv2−2)+ . . . +(lv2−m)=lv2.

Figure 3:
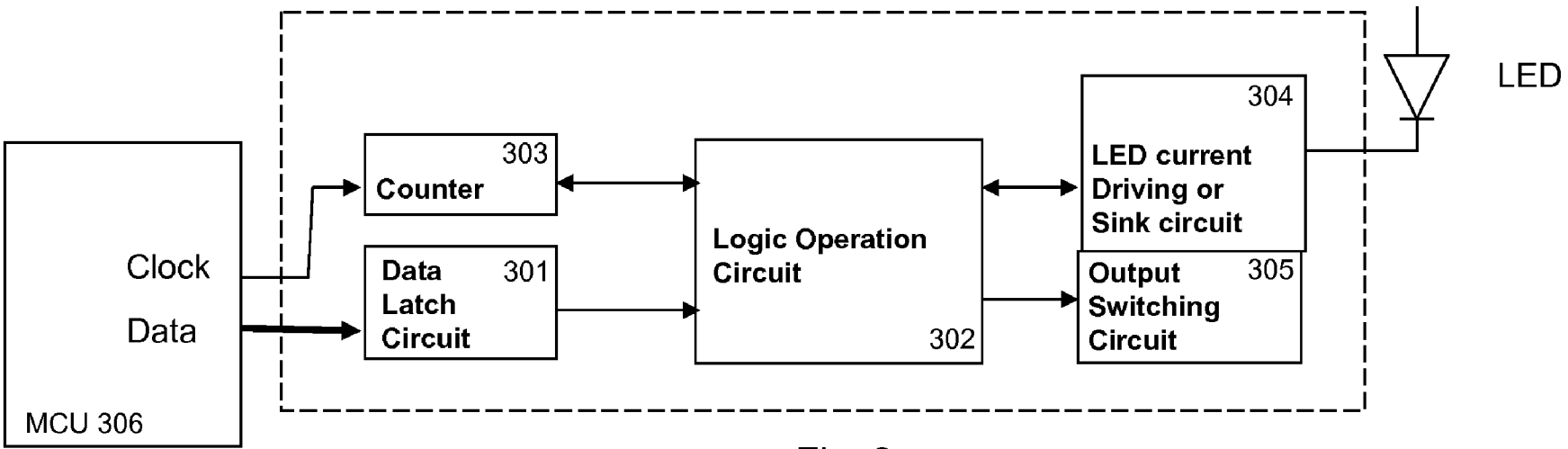
FIG. 3 shows circuit configurations for the PWM integration control
Figure 4A:
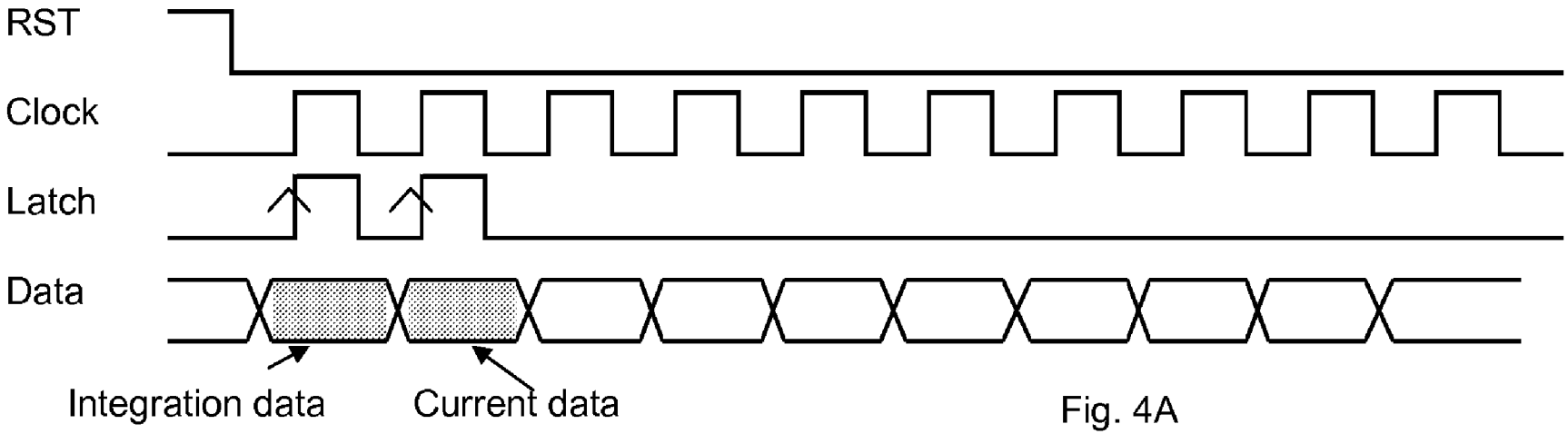
FIG. 4A shows the latched data with two rising-edge signals.
Figure 4B:
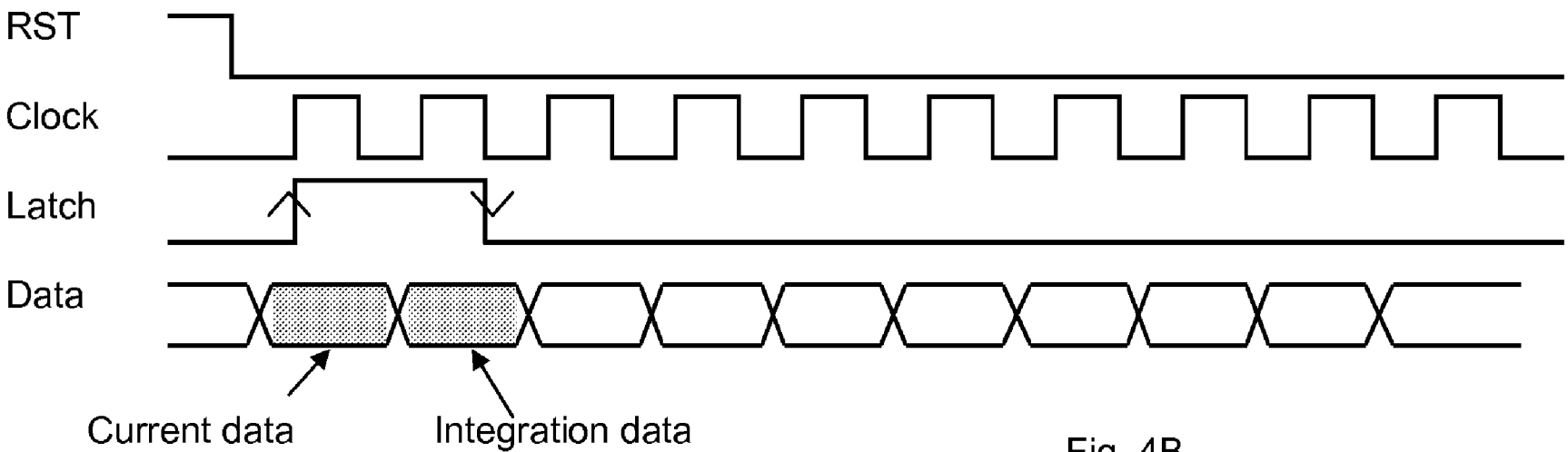
FIG. 4B shows the latched data with a one-rising-edge-and-one-falling-edge signal.

The FIG. 3 shows a Driver IC block diagram. In order to achieve the integration control on the PWM, the LED current flow and brightness data signals are generated by the MCU and first latched by the Data latch Circuit 301. The MCU generates the LED current flow data signals instructing the Driver IC to flow or sink a dedicated current flow for the corresponding LED(s). Also, the MCU generates the brightness integration data signals instructing the Driver IC to output ON or OFF timing wavelength t1−h, t1−1, t2−h, t2−1, . . . (see FIG. 2B) for controlling the sub-light intensity (211, 212, . . . 21*n*, and 221, 222, . . . 22*m* of FIG. 2B). The latched integration data and current flow data are represented by a latch signal (see FIG. 4A and FIG. 4B) in the format of either "two rising edge latch signals" (See FIG. 4A) or "one rising edge and one falling edge latch signal" (see FIG. 4B). Either format (a design issue per implementation requirements) of the latched data signals is transmitted via the same data bus (not shown).

The latched data signal is then transmitted to the Logic Operation Circuit 302. A counter 303, controlled by a clock (not shown), generates the number of counts to the Logic Operation Circuit 302 for calculations. Upon receiving the counter signals and the latched data signals, the Logic Operation Circuit generates control signals to the LED Driving or Sink Circuit 304 for controlling the LED light intensity by way of controlling the LED current flow. Also, the Logic Operation Circuit generates switching control signals by means of the sub-interval time (t1−h, t1−1, t2−h, t2−1, . . . etc.) to the Output Switching Circuit 305 for controlling the sub-light intensity. The same circuit also controls recycle function if there is no new light intensity data input to this circuit. The recycling continues until the Logic Operation Circuit detects a new data signal. A new PWM integration control for the next new image frame begins when a new data signal is detected and followed by recycling of sub-interval time within the new image frame time.

The process of integration control on the PWM is further described by FIG. 5. The Controller MCU first generates the LED current flow signal and brightness data signal to a bus (step 51). The Driver IC then latches the LED current flow signal and the brightness data signal into the latch register (step 52). The counter is reset to be zero (0; step 53). The LED current flow starts under the control of the LED Current Driving or Sink Circuit. The Output Switching Circuit turns ON or OFF the LED(s) per timing interval that is generated by the Logic Operation Circuit (step 54). The number of the count is incremented by one (1) for determination of next sub-light intensity of turning OFF the LED (step 55). Determine if the counter reaches the programmed value (step 56). Determine if new latched data signal is received (step 57). When a new latched data signal is received, reset the counter and continue with LED current flow and turning ON and OFF the LEDs in accordance with the new latched data (step 58).

Figure 6:
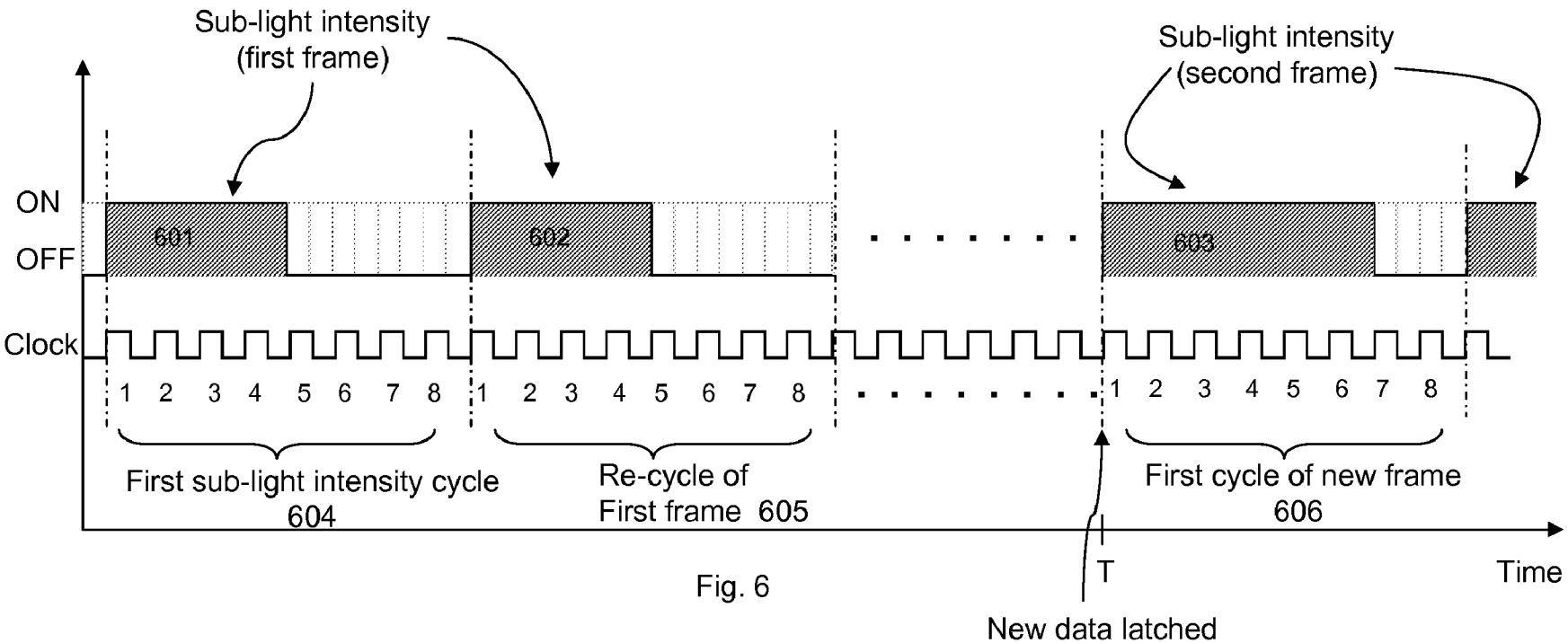
FIG. 6 shows the cycling and re-cycling of image frames implemented by the PWM integration control

The FIG. 6 shows an integration control of PWM with a 3-bits counter case, and 50% Duty Cycle and 75% Duty Cycle frames. The first frame requires a 50% brightness 601, 602 and the second frame requires a 75% brightness 603. The programmed max-counter for the 3-bits counter case is ($2^3$=8). It represents each sub-light intensity of every frame is divided into eight (8) cycles. Because the first frame requires a 50% brightness, the Logic Operation Circuit controls the Output Switching Circuit to turn ON the LED during the first four (4) cycles, 8 cycles*50%=4 cycles. The Logic Operation Circuit then controls the Output Switching Circuit to turn OFF the LED for the remaining four (4) cycles within the first sub-light intensity period 604. When the counter reaches the maximum programmed counter number, the Logic Operation Circuit resets the counter and, when there is no new frame data is received, starts recycling the process of turning ON and OFF for the first frame as described above. When the counter reaches the maximum programmed counter number and a new latched frame data is also received, the Logic Operation Circuit starts controlling the Output Switching Circuit in accordance with the new latched frame data for turning ON and OFF the LED. The second frame shown in FIG. 6 represents a 75% brightness frame. Therefore, the Logic Operation Circuit will control the Output Switching Circuit to turn ON the LED for the first six (6) cycles (8 cycles*75%=6 cycles) and turn OFF the LED for the remaining two (2) cycles within the first sub-light intensity of the second frame 606. When the counter reaches the maximum programmed counter number, the Logic Operation Circuit resets the counter and, when there is no new frame data is received, starts recycling the process of turning ON and OFF for the second frame as described above. The Logic Operation Circuit will control the Output Switching Circuit to turn ON and OFF the LED repeatedly with recycling for a received frame data, and a new cycling/recycling when receiving a new latched frame data.

It is to be understood that the embodiments and variations shown and described herein are merely illustrative of the principles of this invention and that various modifications may be implemented by those skilled in the art without departing from the scope and spirit of the invention.

The invention claimed is:

1. A Light Emitting Diode (LED) lighting control system comprising:

a controller generates electric current data and brightness data wherein the electric current data and the brightness data are latched into latch data signals being transmitting to a driver integrated circuit (IC) by a latch circuit; and a counter circuit defines a counter value to be an initial value;

a logic operation circuit receives the counter value from the counter circuit, and receives the latch data signals from the data latch circuit;

the logic operation circuit determines number of image cycles in accordance with a predetermined bit data (bd) wherein the number of image cycles is $2^{bd}$;

a current driving circuit flows electric current in accordance with light intensity;

the counter circuit increments the counter value by one (1); and the logic operation circuit compares the counter value with the number of image cycles, and if the counter value is not greater than the number of image cycles and no new latch data signals are received, the current driving circuit flows electric current in accordance with the light intensity.

2. The Light Emitting Diode (LED) lighting control system of claim 1 comprising:

the logic operation circuit receives new latch data signals and the current driving circuit flows electric current flow in accordance with new light intensity.

3. The Light Emitting Diode (LED) lighting control system of claim 1 comprising:

the light intensity is defined as percentage of total clock cycles within each image cycle.

4. The Light Emitting Diode (LED) lighting control system of claim 1 comprising:

the new light intensity is defined as percentage of total clock cycles within each image cycle.

5. A Light Emitting Diode (LED) lighting control system comprising:

a logic operation circuit receives a counter value from a counter circuit, and receives latch data signals from a data latch circuit; and the logic operation circuit determines number of image cycles in accordance with a predetermined bit data (bd) wherein the number of image cycles is $2^{bd}$;

a controller generates electric current data and brightness data wherein the electric current data and the brightness data are latched into the latch data signals being transmitting to a driver integrated circuit (IC) by the latch circuit;

a current driving circuit flows electric current in accordance with light intensity;

the counter circuit increments the counter value by one (1); and the logic operation circuit compares the counter value with the number of image cycles, and if the counter value is not greater than the number of image cycles and no new latch data signals are received, the current driving circuit flows electric current in accordance with the light intensity.

6. The Light Emitting Diode (LED) lighting control system of claim 5 comprising:

the logic operation circuit receives new latch data signals and the current driving circuit flows electric current flow in accordance with new light intensity.

7. The Light Emitting Diode (LED) lighting control system of claim 6 comprising:

the new light intensity is defined as percentage of total clock cycles within each image cycle.

8. The Light Emitting Diode (LED) lighting control system of claim 5 comprising:

the light intensity is defined as percentage of total clock cycles within each image cycle.

9. A Light Emitting Diode (LED) lighting control system comprising:

a controller generates electric current data and brightness data wherein the electric current data and the brightness data are latched into latch data signals being transmitting to a driver integrated circuit (IC) by a latch circuit;

a counter circuit defines a counter value to be an initial value;

a logic operation circuit receives the counter value from the counter circuit, and receives the latch data signals from the data latch circuit;

the logic operation circuit determines number of image cycles in accordance with a predetermined bit data (bd) wherein the number of image cycles is $2^{bd}$;

a current driving circuit flows electric current in accordance with light intensity;

the counter circuit increments the counter value by one (1);

the logic operation circuit receives new latch data signals and the current driving circuit flows electric current flow in accordance with new light intensity; and the logic operation circuit compares the counter value with the number of image cycles, and if the counter value is not greater than the number of image cycles and no new latch data signals are received, the current driving circuit flows electric current in accordance with the light intensity.

10. The Light Emitting Diode (LED) lighting control system of claim 9 comprising:

the new light intensity and the light intensity are defined as percentage of total clock cycles within each image cycle.

11. The Light Emitting Diode (LED) lighting control system of claim 10 comprising:

the current driving circuit flows electric current during initial clock cycles which is in amount of the percentage within each image cycle.

12. The Light Emitting Diode (LED) lighting control system of claim 11 comprising:

the current driving circuit terminates the electric current flow at end of the initial clock cycles that is in the amount of the percentage within each image cycle.

* * * * *